United States Patent [19]

Marano

[11] Patent Number: 4,964,631

[45] Date of Patent: Oct. 23, 1990

[54] PORTABLE EXERCISING SET

[76] Inventor: Walter Marano, 2462 Oceanside Rd., Oceanside, N.Y. 11572

[21] Appl. No.: 413,091

[22] Filed: Sep. 27, 1989

[51] Int. Cl.[5] ..... A63B 21/06

[52] U.S. Cl. ..... 272/117; 272/122; 272/143

[58] Field of Search ..... 272/67, 96, 117, 119, 272/122, 123, 124, 143

[56] References Cited

U.S. PATENT DOCUMENTS

| | | | |
|---|---|---|---|
| 2,114,790 | 4/1938 | Venables | 272/119 |
| 2,617,650 | 11/1952 | Landis | 272/122 |
| 4,109,908 | 8/1978 | Pugh et al. | 272/119 |
| 4,345,756 | 8/1982 | Hoagland | 272/122 X |
| 4,607,840 | 8/1986 | Harper | 272/122 X |
| 4,822,035 | 4/1989 | Jennings et al. | 272/123 |

*Primary Examiner*—Robert Bahr

*Attorney, Agent, or Firm*—Stanley I. Laughlin

[57] ABSTRACT

A set of portable exercising devices; one for individually exercising the arm and one for individually exercising the leg. The exercising device is fabricated from solid and tubular metal and/or plastic to form substantially rectangular frames. The frames can be adjusted to fit the arm and legs. Padded circular braces attach the frames to the arms and legs. Weights are attached to the frames either at the corners or at locations on the frames in proximity to the corners.

6 Claims, 4 Drawing Sheets

PORTABLE EXERCISING SET

BACKGOUND OF THE INVENTION

The invention relates to exercising apparatus in general, and in particular to portable exercising devices.

Hand held dumbells and weights to be lifted for use in exercising, as well as stationary exercising machines are well known.

SUMMARY OF THE INVENTION

It is an object of the invention to provide safe and economical exercising devices.

It is a further object of the invention to provide lightweight portable exercising equipment that does not have to be held solely in the hands or remain stationary at one location.

The invention relates to a set of portable exercising devices which comprise solid and tubular cross-sectional metal members forming rectangular frames fashioned to encircle the arms and legs of the exercising person. Various weights may be attached to the frames before the exercising commences.

DETAILED DESCRIPTION

Figure 1:
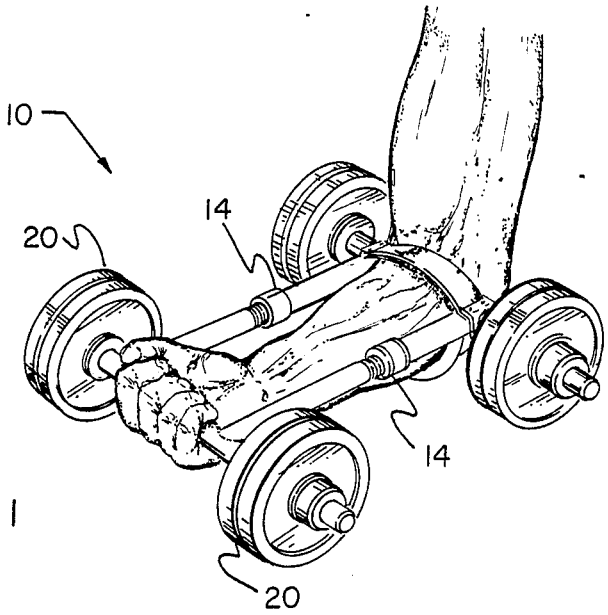
FIG. 1 shows a perspective view of one part of an embodiment of the invention for the exercising of arms.
Figure 2:
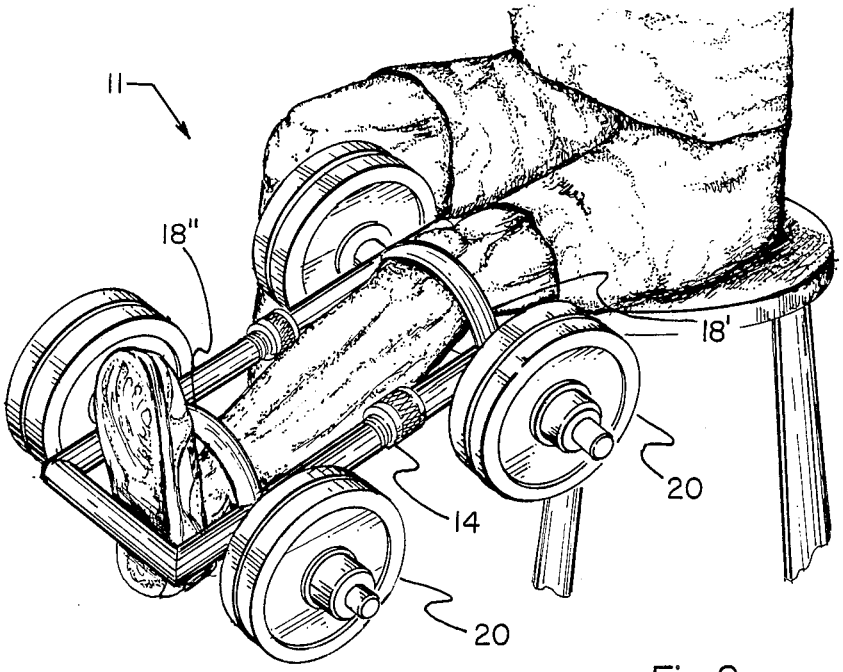
FIG. 2 shows a perspective view of the other part of an embodiment of the invention for the exercising of legs.
Figure 3A:
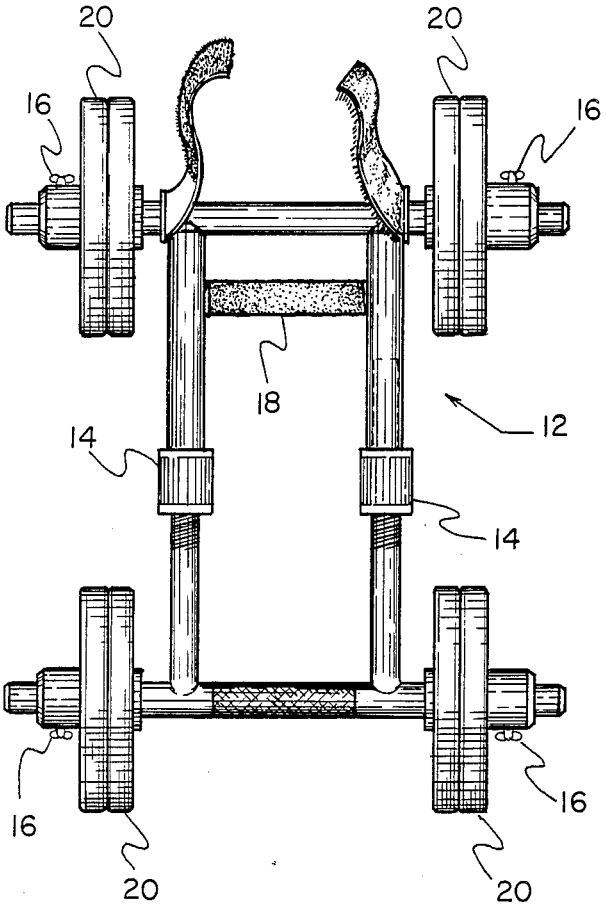
FIGS. 3*a* and 3*b* show plan and front elevation views of the apparatus shown in FIG. 1.
Figure 5A:
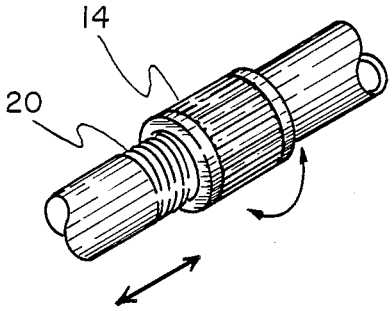
FIGS. 5*a*, 5*b* and 5*c* show details of adjusting the apparatus and attaching the weights to the apparatus of FIGS. 1 and 2.
Figure 3B:
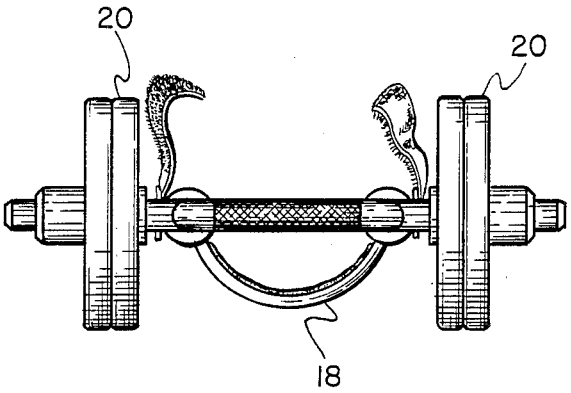

FIGS. 1 and 2 are perspective views showing a person exercising with the invention for the arms and legs respectively. FIGS. 3*a* and 3*b* show in detail the plan and front views of Applicant's portable exercising device (10) for arms. The arm exercising device, which is one of the set of two exercising device comprises a substantially rectangular frame (12) made of solid and tubular cross-sectional metal members and having means (14) for lengthening and shortening the longer sides of said rectangular frame as shown in detail in FIG. 5*a*. Conventional means (16) for attaching various weights to the exercising device (10) are positioned at the corners or in proximity to the corners of the rectangular frame (12) so the weights extend parallel to the longer sides of said rectangular frame. A circular, padded brace (18) for attachment of the forearm of the exercising person is positioned in proximity to one of the shorter sides of the rectngular frame (12).

Figure 5B:
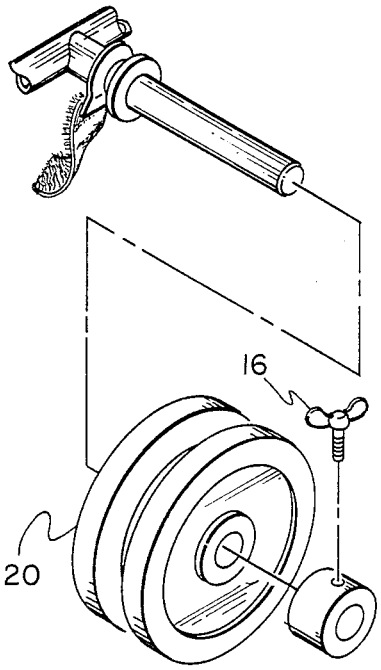
Figure 5C:
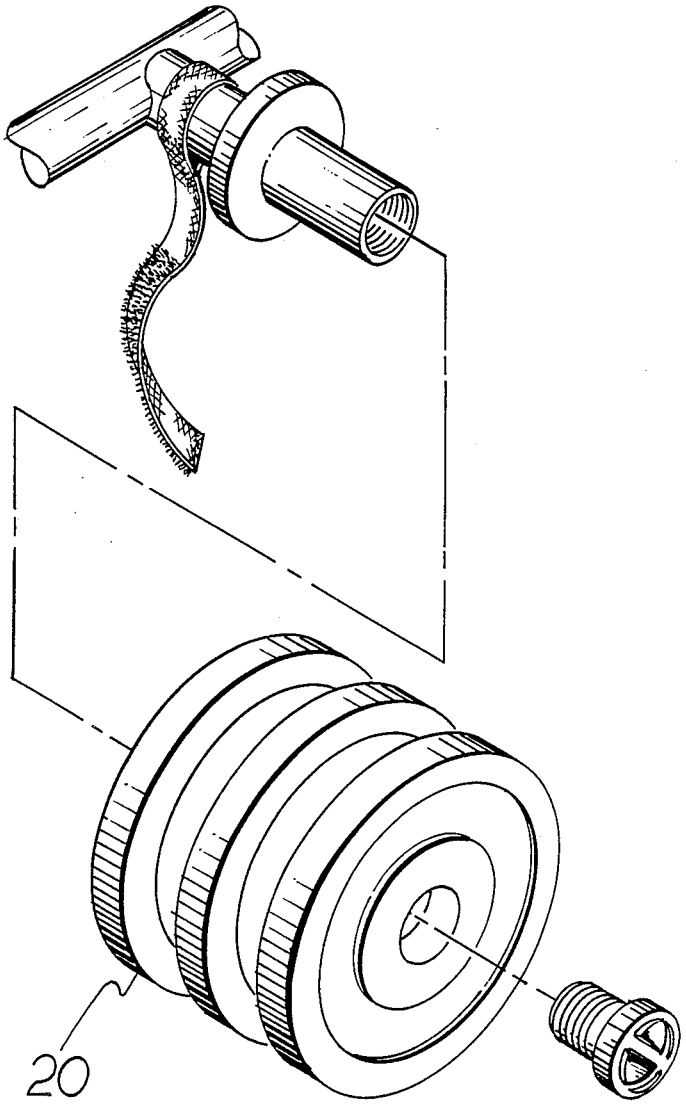

To use apparatus of FIG. 3, adjust the lengthening and shortening means (14) after the padded brace (18) is attached to the forearm. The lengthening and shortening means (14) which can be, inter alia, nuts whose internal threads mate with external threads on either one or both sides of separate metal tubes comprising the longer sides of the rectangular frame. Turning these nuts moves the metal tubes closer together or further apart thereby lengthening or shortening the longer side of the rectangular frame (12) so that the hand is able to grasp the shorter side of the frame (12) opposite the shorter side in proximity to the padded brace (18). Various weights (20) are attached to the frame (12) by conventional means such as shown in FIG. 5*b* or internally threaded caps and nuts such as shown in FIG. 5*c*. The apparatus provides for the free movement of the arm during the exercise period.

Figure 4A:
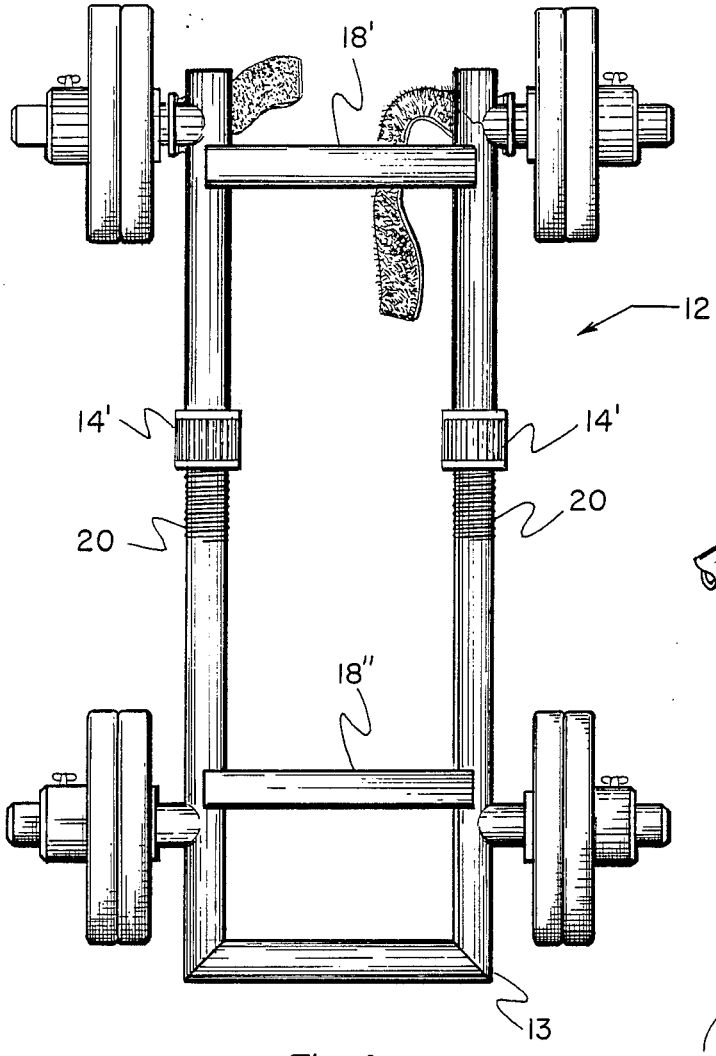
FIGS. 4*a* and 4*b* show plan and front elevation views of the apparatus shown in FIG. 2.
Figure 4B:
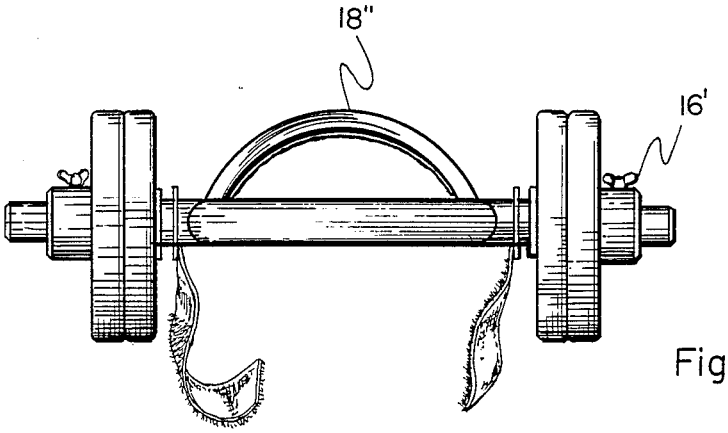

FIGS. 4*a* and 4*b* show the plan and front elevation views of the exercising device (11) for the leg shown in FIG. 2. The leg exercising device which is the other one of the set, comprises a rectangular frame (12) employing one of its shorter sides (13) for resting a foot and is also made of solid and tubular cross-sectional metal members. The lengthening means (14') is similar to the lengthening means described in the foregoing paragraphs except that the threads are longer providing for additional lengthening and shortening of the longer sidea of the rectangular frame. Two padded circular braces 18' and 18'' are used for attaching the exercising devices to the leg; one brace is attached to the knee and one brace is attached to the ankle. The means for attaching the weights are as described above.

To use the apparatus shown in FIGS. 2 and 4, attach the padded braces to the knee and the ankle and adjust the lengthening and shortening means so that the foot is comfortably positioned to rest upon one of the shorter sides of the rectangular frame. Attach the weights and start exercising.

It is possible to make the shorter sides of the rectangular frames of different lengths to accomodate the exercising person whose arm and leg dimensions are not average.

Although only one set of embodiments of the invention is shown, it is expected that the scope and breadth of the invention will only be limited by the scope and breadth of the annexed claims:

I claim:

1. A set of portable exercising devices for separate and individual use by the arms and legs, one of said devices comprising a rectangular frame fabricated from a plurality of solid and tubular cross-sectional metal members, said frame having means for adjusting the length of the longer sides of said rectangulr frame to enable the hand of the exercising person to grasp one of the shorter sides of said rectangular frame, and a circular padded brace positioned in proximity to the shorter side opposite that shorter side grasped by said hand for attaching the brace and said frame to the arm; the other one of said devices comprising a rectangular frame fabricated from a solid and tubular cross-sectional metal member, said frame having means for adjusting the length of the longer side of said rectangular frame to the length of the exercising person's leg and to enable the foot of the exercising person to rest upon a shorter side of said rectangular frame amd a plurality of circular padded braces for attaching said rectangular frame to said leg; each rectangular frame having means for attaching weights in proximity to its corners.

2. A set of portable exercising devices as claimed in claim 1 wherein said rectangular frames fabricated from solid and tubular cross-sectional metal members comprise cross-sectional areas of solid and hollow metal material.

3. A set of portable exercising devices as claimed in claim 1 wherein said adjusting means comprise pairs of tubes that slide within a nut and have external threads that cooperate with the internal threads of said nut for lenghthening and shortening of the longer sides of said rectangular frames.

4. A set of portable exercising devices as claimed in claim 1 wherein said means for attaching weights to said set of exercising devices comprise externally threaded hollow tubular extensions extending from said rectangular frames proximate the corners, and mating externally threaded solid tubular end caps for cooperating with said hollow tubular extensions.

5. A set of portable exercising devices as claimed in claim 1 wherein the shorter sides of said rectangular frames are different.

6. A set of portable exercising devices for the individual use on arms and legs comprising rectangular frames fabricated from a plurality of solid and tubular cross-sectional plastic members, one of said frames having means for adjusting the length of the longer side of said rectangular frame to enable a person's hand to grasp one of the shorter sides of said rectangular frame, and a circular padded brace positioned in proximity to the opposite shorter side for attaching said frame to the arm below the elbow; the other one of said devices comprising a rectangular frame fabricated from solid and tubular cross-sectional plastic member, said frame having means for adjusting the length of the longer side of said rectangular frame to the length of a person's leg thereby enabling a person's foot to rest upon a shorter side of said rectangular frame and a plurality of circular padded braces for attaching said rectangualr frame to said leg; the rectangular frames of said set of portable exercising devices having means for attaching weights in proximity to its corners.

* * * * *